US005839289A

United States Patent [19]

Cho

[11] Patent Number: 5,839,289

[45] Date of Patent: Nov. 24, 1998

[54] MULTI-STEP PRESSURE REDUCING APPARATUS AND METHOD

[75] Inventor: Nam-sik Cho, Kyungki-do, Rep. of Korea

[73] Assignee: Samsung Electronics Co., Ltd., Suwon, Rep. of Korea

[21] Appl. No.: 922,397

[22] Filed: Sep. 3, 1997

[30] Foreign Application Priority Data

Sep. 4, 1996 [KR] Rep. of Korea ..... 96-38278

[51] Int. Cl.[6] ..... F25B 19/00

[52] U.S. Cl. ..... 62/100; 62/268; 417/244

[58] Field of Search ..... 62/100, 268; 417/244, 417/423.5

[56] References Cited

U.S. PATENT DOCUMENTS 3,304,733 2/1967 Coffman ..... 62/100

4,361,418 11/1982 Tscheppe ..... 417/244

4,942,053 7/1990 Franklin et al. ..... 62/100

*Primary Examiner*—Ronald C. Capossela

*Attorney, Agent, or Firm*—Burns, Doane, Swecker & Mathis, L.L.P.

[57] ABSTRACT

The air pressure within a part of an appliance (e.g., a refrigeration pipe of an air conditioner unit) is reduced as the part is conveyed on a conveyor. This pressure reduction is accomplished by connecting a first end of a vacuum hose to the part, and then rotating a rotatable member to which the second end is connected. That causes the second end to be alternately brought into and out of communication with a vacuum source, whereby a vacuum is intermittently induced in the part. During periods when the second end of the vacuum hose is out of communication with the vacuum source, that second hose end is placed in communication with a pressure at least at atmospheric, to temporarily increase the pressure in the part.

6 Claims, 8 Drawing Sheets

MULTI-STEP PRESSURE REDUCING APPARATUS AND METHOD

RELATED INVENTION

This invention relates to an invention disclosed in concurrently filed U.S. Ser. No. 08/922,936 (attorney docket no. 031995-002), the disclosure of which is incorporated by reference herein.

BACKGROUND OF THE INVENTION

1. Field of the Invention

The present invention relates to a pressure reducing apparatus and method for vacuumizing a part which requires a vacuum (hereinafter, referred to as "vacuum-requiring part").

2. Description of the Prior Art

Among various appliances, a typical example of an appliance which must be vacuumized during a certain manufacturing process before it is introduced into a subsequent process, is an outdoor unit of an air conditioner.

The outdoor unit of an air conditioner generally has a compressor and a condenser, which are connected to each other via a refrigerant pipe and a capillary tube. The compressor and the condenser of the outdoor unit cooperate with an evaporator of an indoor unit, to complete a refrigerating cycle.

The air conditioner having the outdoor unit and the indoor unit installed outdoors and indoors, respectively, is generally brought into the market in a state that the refrigerant, being a noxious substance, is filled in the refrigerant pipe of the outdoor unit, for the sake of safety, upon installation of the outdoor unit. While assembling the outdoor unit in a factory, a process for removing moisture and foreign materials which may exist in the refrigerant pipe is generally implemented to avoid contamination of the refrigerant when the refrigerant is subsequently introduced into the refrigerant pipe.

The process for removing moisture and foreign materials from the refrigerant pipe of the outdoor unit, is substantially performed by reducing a pressure in the refrigerant pipe to a vacuum level, and this vacuumizing operation for the refrigerant pipe is effected by connecting the refrigerant pipe to a vacuum pump while the refrigerant pipe is moved on a conveyor in an assembly line.

FIG. 1 illustrates a conventional pressure reducing apparatus which can be used for reducing a pressure in a refrigerant pipe of an outdoor unit. Referring to FIG. 1, the conventional pressure reducing apparatus includes a plurality of vacuum pumps 1, a plurality of cages 2 for supporting the respective vacuum pumps 1, a cage rail 3 for guiding movement of the respective cages 2, and an electric power supply rail 4 for supplying electric power to the respective vacuum pumps 1. The drawing reference numeral 6 designates a pallet on which an outdoor unit 5 of an air conditioner is loaded and conveyed.

Referring to FIG. 2, the respective cages 2 are suspended from the cage rail 3 by rollers 8, and are spaced from each other at a constant distance while coupled to a chain 9 disposed beneath the cage rail 3. The respective cages 2 are moved along the cage rail 3 together with the chain 9 which is driven by a chain driving portion 10 (see FIG. 1).

The distance between two adjacent cages 2 moved along the cage rail 3 and a moving velocity of the respective cages 2 are set to be the same as a distance between two adjacent outdoor units 5 conveyed on a conveyor 7 and a conveying velocity of the respective outdoor units 5, respectively.

The respective vacuum pumps 1 equipped onto the respective cages 2 are supplied with electric power through a cable connected by a sliding brush 11 to the electric power supply rail 4. First ends of a pair of vacuum hoses 12 are connected to a pair of output ports of respective vacuum pumps 1. A pair of quick couplings 13 are provided on the other ends of the respective vacuum hoses 12 and are connected to the ends of refrigerant pipes 14 of the respective outdoor units 5 conveyed on the conveyor 7.

In FIG. 2, the drawing reference numerals 15 and 16 respectively designate a pair of cord reels and a pair of cords elastically wound around the cord reels. The cords 16 function to pull up the vacuum hoses 12 above the conveyor 7, so as not to hinder any other operations when the vacuum hoses 12 are disconnected from the refrigerant pipe 14.

Hereinafter, a pressure reducing method performed using the conventional pressure reducing apparatus constructed as mentioned above will be described with reference to FIG. 3.

Referring to FIG. 3, in a moving track of the vacuum pumps 1, a straight stretch between points A and B, adjacent to the conveyor 7, represents a current-carrying section of the electric power supply rail 4, in which electric power is supplied to the vacuum pumps 1. In the remainder of the electric power supply rail 4, electric power is not supplied to the vacuum pumps 1.

When the outdoor unit 5, after passing through several processes, is introduced into one end of the conveyor 7 adjacent the point A which is a starting point of the current-carrying section of the electric power supply rail 4, the vacuum hoses 12, already connected to the vacuum pump 1, are connected to respective refrigerant pipes 14 of the outdoor unit 5, by a worker 18*a* positioned close to the point A. As the vacuum pump 1 moves at the same velocity as the outdoor unit 5 from point A to point B, a pressure reducing operation for the refrigerant pipes 14 by the vacuum pump 1 is undertaken.

The pressure reducing operation for the refrigerant pipes 14 by the vacuum pump 1 is continued until the outdoor unit 5 conveyed on the conveyor 7 reaches the point B which is an end point of the current-carrying section of the electric power supply rail 4. After the outdoor unit 5 passes through the point B, the hoses 12 are disconnected from the refrigerant pipes 14 of the outdoor unit 5, by another worker 18*b* positioned close to the point B. By this operation, the pressure reducing operation for the refrigerant pipe 14 by the vacuum pump 1 is completed.

However, in the conventional pressure reducing method and apparatus, the vacuum pump 1 performs the pressure reducing operation continuously without any interruption, while the vacuum hoses are connected to the refrigerant pipes. A pressure reducing efficiency of the vacuum pump 1 is less than desired, and it takes a relatively long time for a pressure in the refrigerant pipe 14 of the outdoor unit 5 to be reduced to a desired vacuum level.

Since a time for vacuumizing the refrigerant pipe 14 is lengthy, a time required for assembling the outdoor unit 5 is also lengthy, and thereby productivity is significantly minimized.

Also, if the time for vacuumizing the refrigerant pipe 14 is lengthy, as described above, the current-carrying section for the electric power supply rail 4 must also be lengthy, which causes the required number of vacuum pumps 1 to be relatively large. As a result, a cost for equipping the pressure reducing apparatus increases.

SUMMARY OF THE INVENTION

The present invention has thus been constructed to overcome one or more of the above described problems of the prior art. Accordingly, it is an object of the present invention to provide a multi-step pressure reducing apparatus and method which is capable of remarkably shortening a time for a vacuum-requiring part to reach to a desired vacuum level.

According to one aspect of the present invention, there is provided a multi-step pressure reducing apparatus comprising: a plurality of vacuum pumps; a plurality of air hoses each having one end connected to the respective vacuum pumps; a fixed connection member secured to a frame and having a plurality of first communication holes each connected to the other end of the respective air hoses; a rotating connection member rotatably engaged with the fixed connection member and having a plurality of second communication holes; a plurality of vacuum hoses each having one end connected to the respective second communication holes and the other end detachably connected to a vacuum-requiring part of an appliance conveyed on a conveyor; and a rotating connection member driving portion for rotating the rotating connection member relative to the fixed connection member.

By the feature of the present invention, when the vacuum pumps are simultaneously actuated, the rotating connection member having the vacuum hoses connected thereto is rotated relative to the fixed connection member. By this, a procedure for allowing the communication between the first and second communication holes and a procedure for shutting off the communication between the first and second communication holes are alternately repeated.

In other words, if the second communication holes of the rotating connection member are aligned with the first communication holes of the fixed connection member, the vacuum pumps are communicated with the vacuum hoses through the first and second communication holes, respectively. Accordingly, a pressure reducing operation for a vacuum-requiring part of an appliance conveyed on a conveyor can be implemented. If the second communication holes of the rotating connection member are not aligned with the first communication holes of the fixed connection member, the vacuum pumps are not communicated with the vacuum hoses, and accordingly the pressure reducing operation for the vacuum-requiring part of the appliance is interrupted.

As a result, by sequentially connecting the respective vacuum pumps to the vacuum-requiring parts of the appliances and rotating the rotating connection member relative to the fixed connection member to a velocity which is the same as one of the conveyor, the vacuum-requiring part can be communicated with the vacuum pump, or can be restrained from being communicated with the vacuum pump. Therefore, while procedures for allowing or shutting off the communication between the vacuum-requiring part and the vacuum pump are alternately repeated, the pressure reducing operation can be performed, whereby it is possible to shorten a time required for the vacuum-requiring part to reach to a desired vacuum level.

BRIEF DESCRIPTION OF THE DRAWINGS

The above object, and other features and advantages of the present invention will become more apparent by describing in detail a preferred embodiment thereof with reference to the accompanying drawings, in which.

DETAILED DESCRIPTION OF A PREFERRED EMBODIMENT OF THE INVENTION

Figure 1:
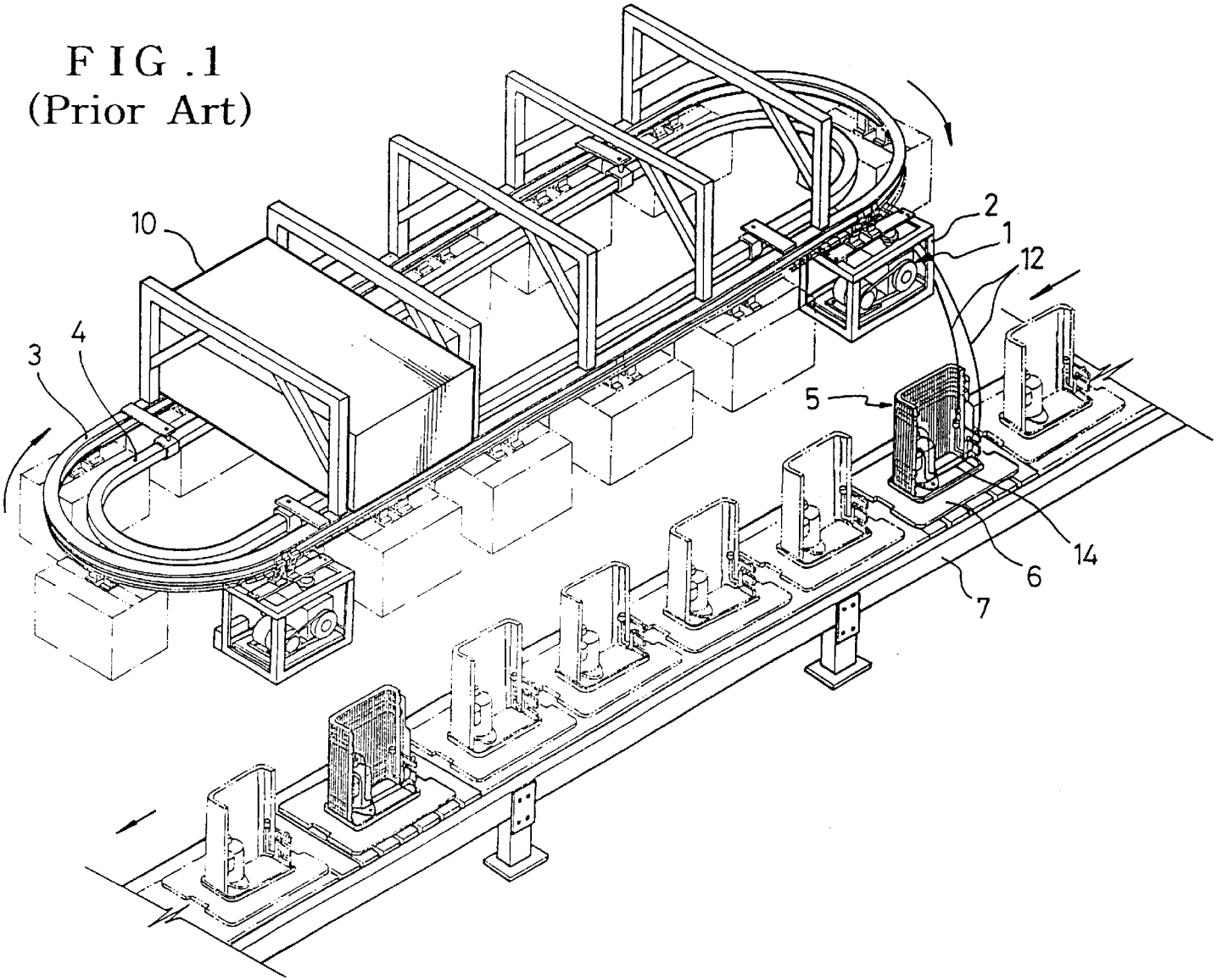
FIG. 1 (Prior Art)
FIG. 1 is a top perspective view of a conventional pressure reducing apparatus.
Figure 2:
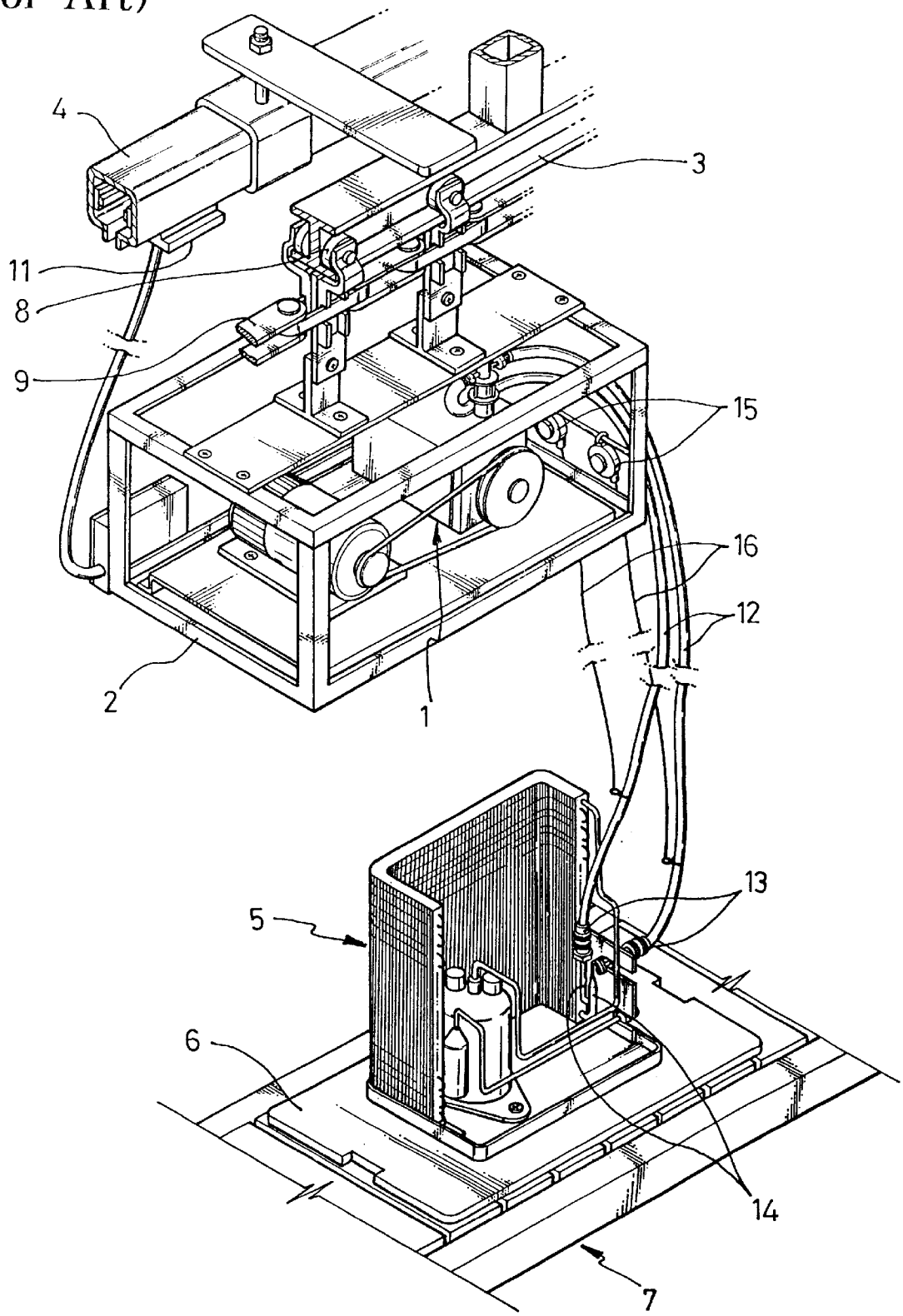
FIG. 2 (Prior Art)
FIG. 2 is an enlarged top perspective view of a main construction of the conventional pressure reducing apparatus shown in FIG. 1.
Figure 3:
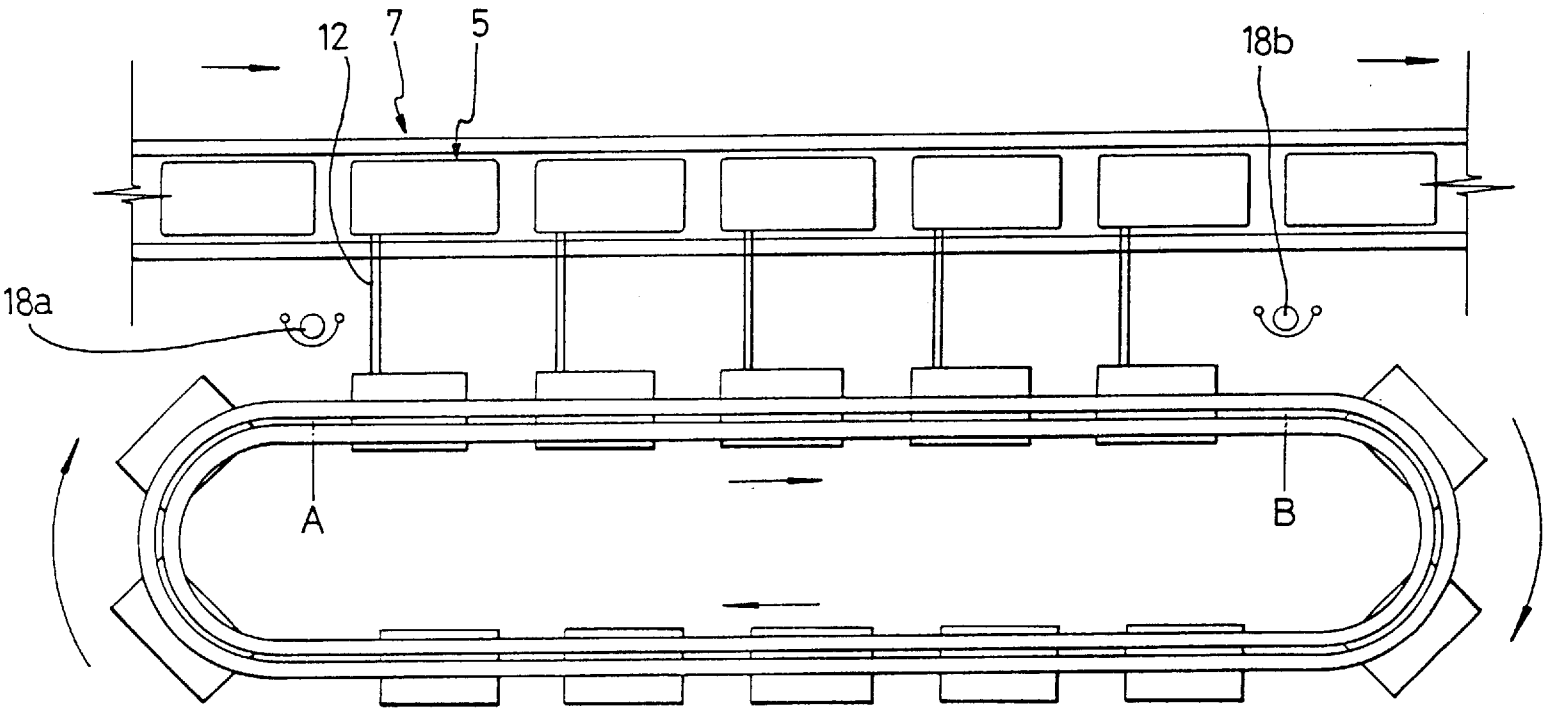
FIG. 3 (Prior Art)
FIG. 3 is a plan view for illustrating the pressure reducing method performed by the conventional pressure reducing apparatus of FIG. 1.

Reference will now be made in greater detail to a preferred embodiment of the invention, examples of which are illustrated in the accompanying drawings. This invention, however, may be embodied in many different forms and should not be construed as limited to the embodiment set forth herein; rather, this embodiment is provided so that this disclosure will be through and complete, and will fully convey the scope of the invention to those skilled in the art. Wherever possible, the same reference numerals will be used throughout the drawings to refer to the same or like parts.

Figure 4:
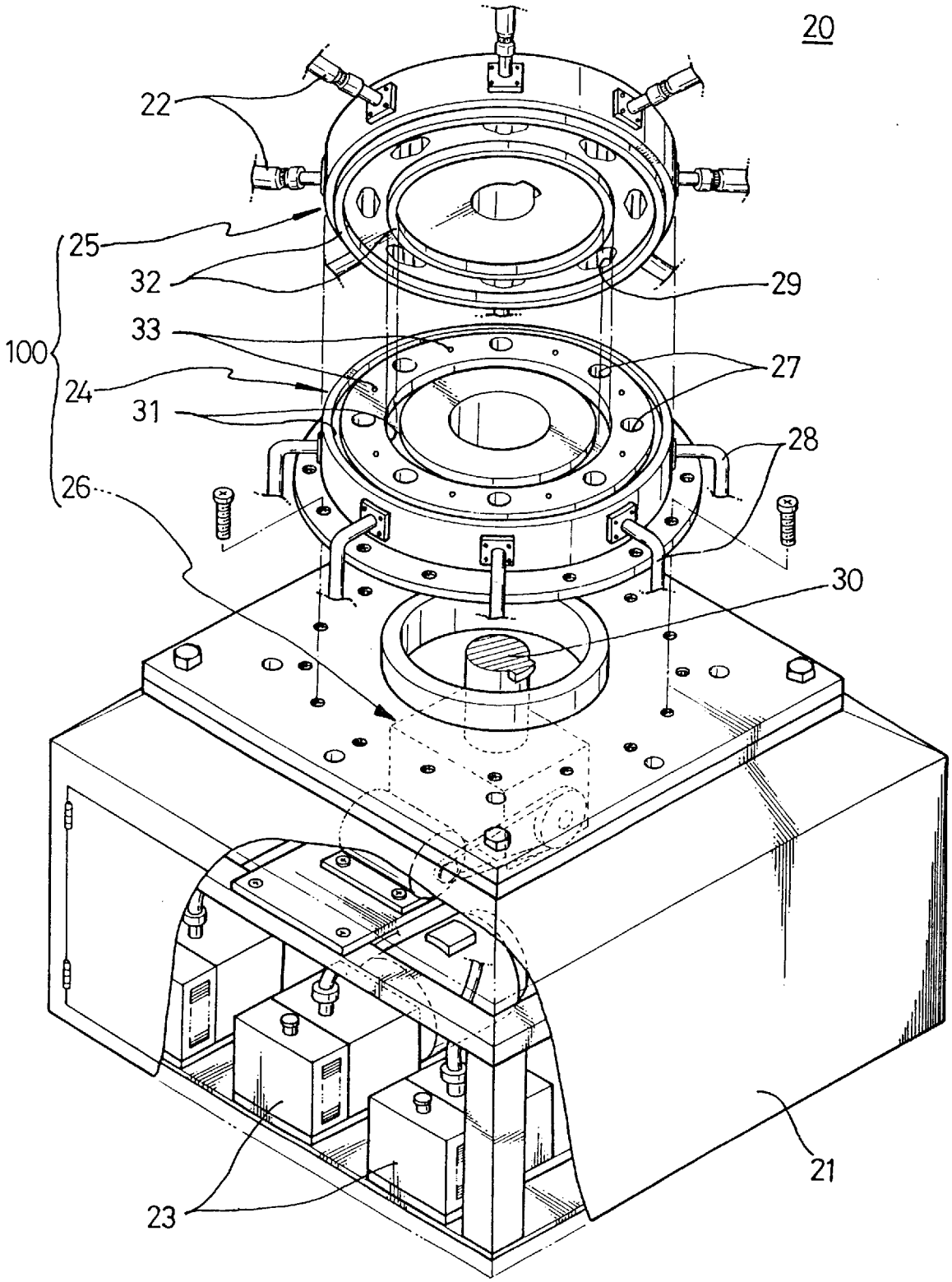
FIG. 4 is an exploded perspective view of a multi-step pressure reducing apparatus in accordance with an embodiment of the present invention.

FIG. 4 illustrates an exploded perspective view of a multi-step pressure reducing apparatus in accordance with an embodiment of the present invention. Referring to FIG. 4, a multi-step pressure reducing apparatus 20 includes a plurality of vacuum hoses 22, a plurality of vacuum pumps 23, and a vacuum pump intermittent connection means 100 provided between the vacuum hoses 22 and the vacuum pumps 23 to intermittently connect the respective vacuum hoses 22 to the respective vacuum pumps 23.

The vacuum pump intermittent connection means 100 includes a fixed connection member 24 fixedly positioned with respect to the vacuum pumps 23, a rotating connection member 25 rotatably engaged with the fixed connection member 24, and a rotating connection member driving portion 26 for rotating the rotating connection member 25 relative to the fixed connection member 24.

The vacuum pumps 23 are received in a frame 21, and the fixed connection member 24 is secured to an upper wall of the frame 21.

Figure 5:
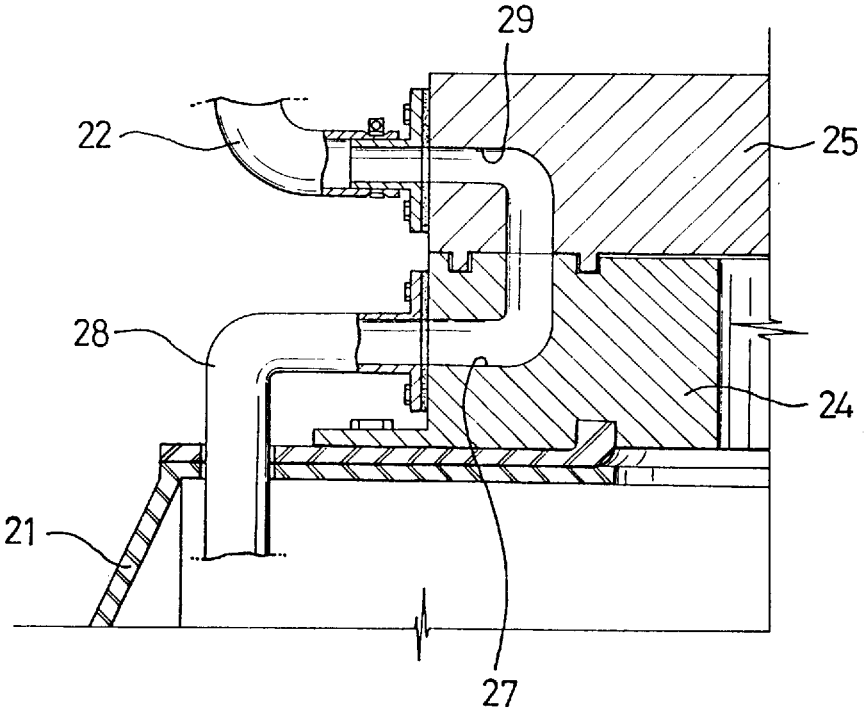
FIG. 5 is a cross-sectional view of a main construction of the multi-step pressure reducing apparatus shown in FIG. 4.

The fixed connection member 24, as shown in FIG. 5, is formed with a plurality of first communication holes 27 each of which has one end projecting through an upper surface of the fixed connection member 24 and another end projecting through a circumferential outer surface of the fixed connection member 24. The first communication holes 27 are spaced apart from each other at a constant distance. The other ends of the first communication holes 27 are connected to the respective vacuum pumps 23 through a plurality of air hoses 28.

As can be seen from FIG. 4, the rotating connection member 25 is keyed to a driving shaft 30 of the rotating connection member driving portion 26 mounted to the frame 21. By operating the rotating connection member driving portion 26, the rotating connection member 25 can be rotated relative to the fixed connection member 24, while ensuring an airtight contact between the fixed connection member 24 and the rotating connection member 25.

The rotating connection member 25, as shown in FIG. 5, is formed with a plurality of second communication holes 29 each which has one end projecting through an lower surface of the rotating connection member 25 and the other end projecting through a circumferential outer surface of the rotating connection member 25. The second communication holes 29 are spaced apart from each other at the same distance as the first communication holes 27, and are positioned at the same radial distance from a center axis, as the first communication holes 27. The vacuum hoses 22 are connected to respective second communication holes 29.

A pair of radially spaced annular recesses 31 are formed on the upper surface of the fixed connection member 24 at radially spaced inner and outer positions, respectively, with respect to the first communication holes 27, and a pair of radially spaced annular projections 32 are formed on the lower surface of the rotating connection member 25 at radially spaced inner and outer positions, respectively, with respect to the second communication holes 29. The circumferential projections 32 are slidably engaged in the circumferential recesses 31, with a lubricant such as oil being interposed therebetween to ensure airtight contact.

In a preferred embodiment of the present invention, pin holes 33 are formed between adjacent ones of the first communication holes 27. The pin holes 33 extend completely through the fixed connection member 24. The purpose of the pin holes 33 will be fully described later.

Figure 6:
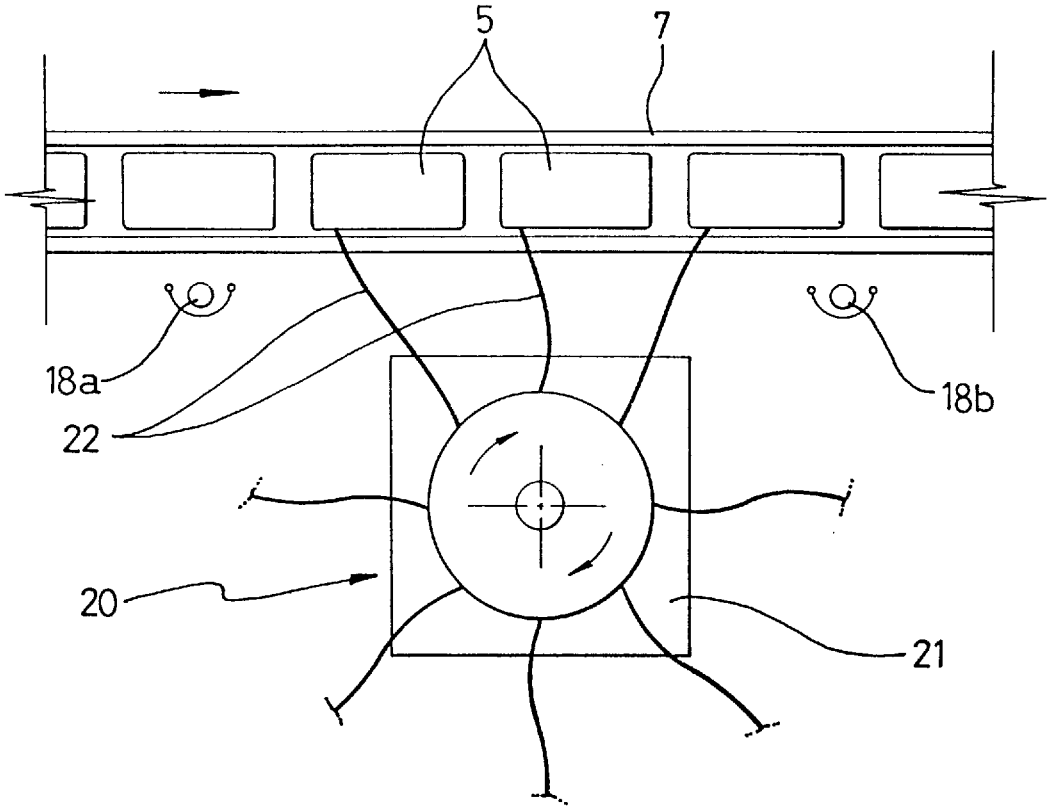
FIG. 6 is a schematic plan view for illustrating a pressure reducing operation for a refrigerant pipe of an outdoor unit of an air conditioner, performed by the multi-step pressure reducing apparatus according to the present invention.

FIG. 6 shows the multi-step pressure reducing apparatus of the present invention applied to an assembly line for making outdoor air conditioner units. Referring to FIG. 6, a multi-step pressure reducing operation conducted by the multi-step pressure reducing apparatus 20 according to the present invention can be initiated by connecting the vacuum hoses 22 to refrigerant pipes (not shown) of respective outdoor units 5 conveyed on a conveyor 7. This connection is made by a worker 18*a* positioned close to one end of the multi-step pressure reducing apparatus 20. The operation can be terminated by disconnecting the vacuum hoses 22 from the refrigerant pipes. The disconnection is performed by another worker 18*b* positioned close to the other end of the multi-step pressure reducing apparatus 20.

By then actuating the rotating connection member driving portion 26, the rotating connection member 25 is rotated relative to the fixed connection member 24. As a result, the respective vacuum hoses 22 are also rotated.

As the rotating connection member 25 is rotated, the respective second communication holes 29 formed in the rotating connection member 25 will alternately come into and out of alignment with the first communication holes 27 formed in the fixed connection member 24. An aligned state is best shown in FIGS. 5 and 7 and a non-aligned state is best shown in FIG. 8.

Figure 7:
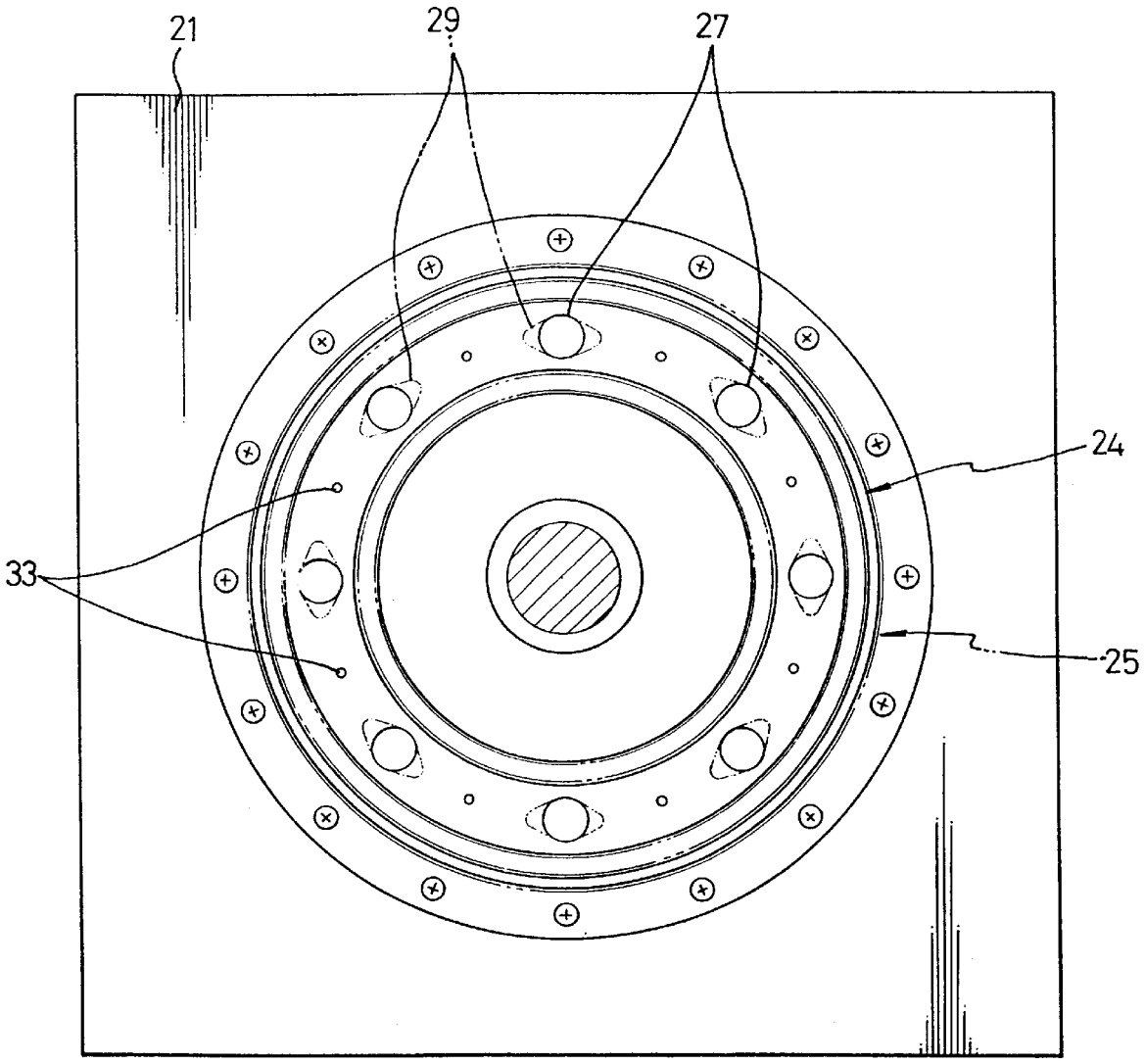
FIG. 7 is a plan view for illustrating a positional relationship between a fixed connection member and a rotating connection member when a pressure in a vacuum-requiring part is reduced by the multi-step pressure reducing apparatus according to the present invention.

As shown in FIG. 7, when the second communication holes 29 of the rotating connection member 25 are aligned with the first communication holes 27 of the fixed connection member 24 while the vacuum pumps 23 are actuated, the respective vacuum hoses 22 connected to the other end of the second communication holes 29 of the rotating connection member 25 are communicated with the respective vacuum pumps 23, whereby the multi-step pressure reducing operation for the refrigerant pipe of the outdoor unit 5 conveyed on the conveyor 7 can be implemented.

The second communication holes 29 of the rotating connection member 25 are formed in a circumferential direction, i.e., they have a non-circular cross section, such that they are circumferentially longer than the first communication holes 27. This is done, in order to regulate the time period during which the refrigerant pipe of the outdoor unit 5 conveyed on the conveyor 7 is connected to a vacuum pump 23 to enable the pump to sufficiently reduce the pressure in the vacuum pump 23 to a desired vacuum level.

Figure 8:
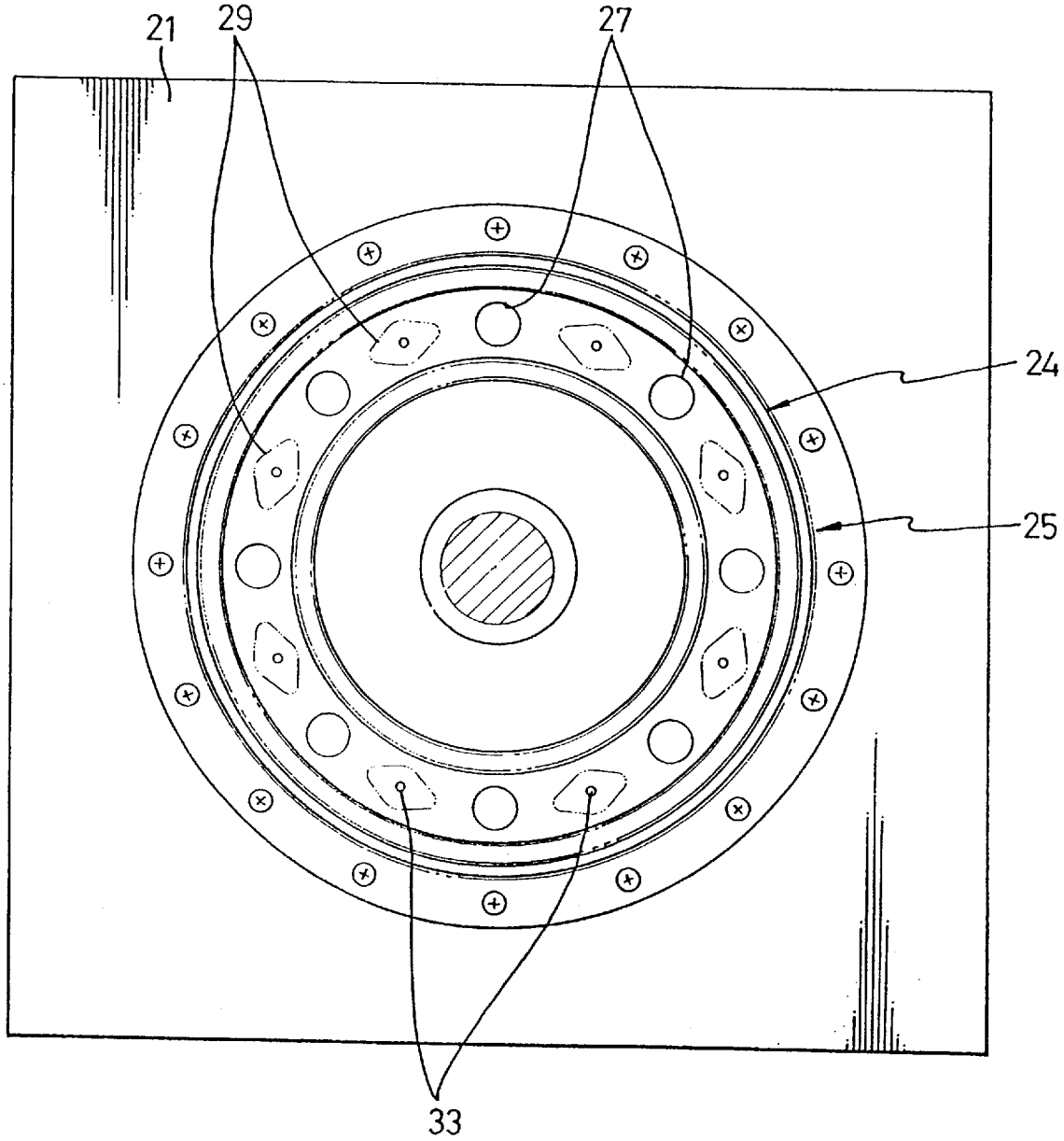
FIG. 8 is a plan view for illustrating another positional relationship between the fixed connection member and the rotating connection member when a pressure in the vacuum-requiring part is somewhat elevated by the multi-step pressure reducing apparatus according to the present invention.

As the rotating connection member 25 is moved from the position shown in FIG. 7 to the position shown in FIG. 8, the second communication holes 29 of the rotating connection member 25 move out of alignment with the first communication holes 27, so the pressure reducing operation for the refrigerant pipe of the outdoor unit 5 is interrupted.

When the second communication holes 29 of the rotating connection member 25 become aligned with the pin holes 33 formed between the respective first communication holes 27 of the fixed connection member 24, some outside air (i.e., air at least at atmospheric pressure) can be introduced into the refrigerant pipe of the outdoor unit 5 through the pin holes 33, so that the pressure in the refrigerant pipe can be temporarily elevated. As a result, particles in the refrigerant pipes are subjected to repeated pressure reductions and increases, which tends to detach the particles from the pipe walls.

Accordingly, the pressure reducing operation for an appliance performed by the multi-step pressure reducing apparatus of the present invention, can be multi-stepwise implemented in that a pressure reducing procedure and a pressure elevating procedure for a vacuum-requiring part are alternately repeated while the rotating connection member 25 is rotated relative to the fixed connection member 24.

The number of pumps 23 that are operated depends upon the number of pressure-reducing steps that are to be performed in order to reduce the pressure in each of the refrigerant pipes. If a three-step pressure-reducing operation is desired, then only three of the pumps 23 are actuated sot hat each of the hoses 22 transmits a vacuum only three times while connected to a respective refrigerant pipe. If a four-step operation were desired, then four of the pumps would be actuated, and so forth.

An appropriate number of pressure reducing (and pressure elevating) steps for properly vacuumizing the refrigerant pipes of a particular outdoor unit can be determined through experiments.

According to the result of an experiment conducted by the present applicant, a time needed for obtaining a given vacuumizing pressure was shortened approximately 30% for the present pressure reducing apparatus, as compared with the conventional pressure reducing apparatus. That is, a time required for assembling the appliance can be shortened, and thereby productivity can be significantly increased. That occurs, because the effectiveness of a vacuuming step is greatest at the very beginning; the present invention utilizes a number of such steps per refrigerant pipe and thus takes advantage of such effectiveness numerous times. This is explained in more detail in the above-mentioned concurrently filed application.

Further, by the multi-step pressure reducing apparatus according to the present invention as described above, since the time required for vacuumizing a vacuum-requiring part of an appliance can be shortened, the number of vacuum pumps needed for a pressure reducing apparatus can also be reduced, and thereby a cost for installing the pressure reducing apparatus can be reduced.

Additionally, when the second communication holes 29 of the rotating connection member 25 become aligned with the pin holes 33 formed between the respective first communication holes 27 of the fixed connection member 24, some outside air can be introduced into the refrigerant pipe of the outdoor unit 5 through the pin holes 33, so that the pressure in the refrigerant pipe can be temporarily elevated. Thanks to this fact, foreign materials adhered to an inner surface of the refrigerant pipe are apt to be detached therefrom due to a pressure variation. Accordingly, when the pressure reducing operation by the vacuum pump restarts, the foreign materials can be easily discharged out of the refrigerant pipe.

While the present invention has been particularly shown and described with reference to a particular embodiment above, those skilled in the art should understand that various changes and modifications in form and details may be effected therein without departing from the spirit and scope of the invention as defined by the appended claims and their equivalents.

What is claimed is:

1. A multi-step pressure reducing apparatus comprising:

a plurality of vacuum pumps;

a plurality of air hoses each having first and second ends, the first end connected to a respective one of said vacuum pumps;

a fixed connection member having a plurality of first communication holes each connected to the second end of a respective one of said air hoses;

a rotating connection member rotatably engaged with said fixed connection member and having a plurality of second communication holes;

a plurality of vacuum hoses each having a first end connected to a respective one of said second communication holes and a second end adapted to be detachably connected to a vacuum-requiring part of an appliance conveyed on a conveyor; and a rotating connection member driving portion for rotating said rotating connection member relative to said fixed connection member for alternately bringing said first communication holes into alignment with said second communication holes to intermittently conduct a vacuum through each of said vacuum hoses.

2. A multi-step pressure reducing apparatus according to claim 1, wherein pin holes are formed in said fixed connection member between pairs of adjacent ones of said first communication holes; said second communication holes arranged to come into alignment with said pin holes while out of alignment with said first communication holes, said pin holes communicating with a pressure at least at atmospheric.

3. A multi-step pressure reducing apparatus according to claim 1 wherein one of said connection members includes radially spaced annular recess arranged on opposite sides of said first and second communication holes, and the other of said connection numbers includes radially spaced annular projections slidably disposed in respective ones of said recesses, and a lubricant disposed in said recesses, for providing an air seal around said communication holes.

4. A multi-step pressure reducing apparatus according to claim 1 wherein the communication holes of one of said pluralities of first and second communication holes are of longer dimension in a direction of rotation of said rotating connection member than are the communication holes of the other of said pluralities of first and second communication holes.

5. A method of reducing pressure in a vacuum-requiring part of an appliance while conveying said part on a conveyor, comprising the steps of:

A) connecting a first end of a vacuum hose to said part; and

B) rotating a rotatable member to which a second end of said vacuum hose is connected, in a manner alternately bringing said second end into and out of alignment with a vacuum source while said hose is connected to said part.

6. The method according to claim 5, wherein step B further includes bringing said second end into communication with a source of pressure at least at atmospheric during periods when said second end is out of communication with said vacuum source.

* * * * *